US012419421B2

(12) United States Patent
Bergman et al.

(10) Patent No.: US 12,419,421 B2
(45) Date of Patent: Sep. 23, 2025

(54) FOLDABLE LOCKING STEP STOOL

(71) Applicants: Judah Bergman, Lakewood, NJ (US); Yishak Sultan, West Long Branch, NJ (US); Jiaxuan Ma, Lakewood, NJ (US)

(72) Inventors: Judah Bergman, Lakewood, NJ (US); Yishak Sultan, West Long Branch, NJ (US); Jiaxuan Ma, Lakewood, NJ (US)

(73) Assignee: Jool Products, LLC, Lakewood, NJ (US)

( * ) Notice: Subject to any disclaimer, the term of this patent is extended or adjusted under 35 U.S.C. 154(b) by 744 days.

(21) Appl. No.: 17/743,098

(22) Filed: May 12, 2022

(65) Prior Publication Data

US 2023/0363538 A1 Nov. 16, 2023

(51) Int. Cl.
*A47C 4/10* (2006.01)
*A47C 12/00* (2006.01)

(52) U.S. Cl.
CPC ..... *A47C 4/10* (2013.01); *A47C 12/00* (2013.01)

(58) Field of Classification Search
CPC ..... A47C 4/10; A47C 12/00
USPC ..... 182/33
See application file for complete search history.

(56) References Cited

U.S. PATENT DOCUMENTS

| | | | | | |
|---|---|---|---|---|---|
| 6,026,933 | A * | 2/2000 | King | E06C 1/393 | 182/161 |
| D615,667 | S * | 5/2010 | Dunn | D25/65 | |
| 8,875,840 | B2 * | 11/2014 | Chancler | A47C 4/10 | 182/33 |
| 9,648,958 | B2 * | 5/2017 | Pectol | A47C 9/10 | |
| 9,986,843 | B2 * | 6/2018 | Baker | A47C 12/00 | |
| 10,271,655 | B1 * | 4/2019 | Gwen | A47C 4/10 | |
| 10,694,859 | B1 * | 6/2020 | Wickland | A47C 4/045 | |
| 11,622,621 | B2 * | 4/2023 | Obioha | A47B 3/10 | 108/115 |
| 11,655,676 | B2 * | 5/2023 | Foley | E06C 7/14 | 248/238 |
| 11,903,486 | B2 * | 2/2024 | Dokhanian | A47C 4/045 | |
| 2009/0261643 | A1 * | 10/2009 | Kay | A47C 9/10 | 297/335 |
| 2024/0108144 | A1 * | 4/2024 | Merey | A47C 12/00 | |

* cited by examiner

*Primary Examiner* — Daniel J Troy
*Assistant Examiner* — Timothy M Ayres
(74) *Attorney, Agent, or Firm* — Christopher Pilling

(57) ABSTRACT

A foldable locking step stool includes a stool platform configured to hingedly fold into a first stool platform member and a second stool platform member. The stool has a child-proof locking mechanism preventing a child from pinching their fingers when the stool platform folds. The child-proof locking mechanism includes a pair of slider elements required to be engaged simultaneously to release a pair of locking bolts enabling the folding of the stool. Overmolded grips ensure traction during use. An integrated handle is hidden when the stool is in use, but accessible when moving or stowing the stool.

13 Claims, 4 Drawing Sheets

FOLDABLE LOCKING STEP STOOL

CROSS-REFERENCE TO RELATED APPLICATIONS

N/A

BACKGROUND OF THE INVENTION

1. Field of the Invention

The present invention relates generally to stools, and more particularly to a foldable locking step stool.

2. Description of Related Art

Step stools are normal tools necessary for children to access things that they are simply not tall enough to reach, such as the bathroom sink. Foldable stools offer the convenience of storing the stool with a reduced footprint. However, the foldability of the stools creates an unintended consequence: the danger of pinching the child during use. As best known at the time of this disclosure, there are no folding step stools that currently pass the children safety standard in the United States. Consequently, a solution is needed.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is an object of the present invention to provide a child-proof lock release enabling the foldable step stool to change from a locked to an unlocked state such that the stool may fold.

In order to do so, a foldable locking step stool comprising a stool platform configured to hingedly fold into a first stool platform member and a second stool platform member; leg members hingedly coupled to the stool platform; a child-proof locking mechanism; an open position defining when the first stool platform member and the second stool platform are locked via the child-proof locking mechanism in a single plane wherein the foldable locking step stool is ready for use; and, a closed position defining when the first stool platform member and the second stool platform are unlocked via the locking mechanism child-proof and folded wherein the foldable locking step stool is configured to be moved or stowed, wherein the locking mechanism comprises a pair of slider elements required to be engaged simultaneously to unlock the child-proof locking mechanism ensuring a child does not pinch their fingers when the foldable locking step stool transforms from the open position to the closed position.

In one embodiment, the first stool platform member and the second stool platform member are configured to fold such that the bottom surfaces of each stool platform member face each other. In one embodiment, each stool platform member comprises a plurality of protrusions configured to interconnect with each other. In another embodiment, the interconnected protrusions are hingedly attached to each other forming a hinge member enabling the folding of the first stool platform member and the second stool platform member. In yet another embodiment, the interconnected protrusions surround a hinge pin. In one embodiment, a handle is further provided. In another embodiment, the handle is an extension of the second stool platform member. In yet another embodiment, the first stool platform member comprises a cutout sized and shaped to receive the handle when the stool platform is in the open position. In one embodiment, the stool platform includes a plurality of traction grips preventing the child from slipping off the step stool during use. In one embodiment, the plurality of traction grips are constructed from a thermoplastic elastomer overmold creating a rigid bond between the plurality of traction grips and a top portion of the stool platform, wherein the stool platform is constructed from a rigid material. In one embodiment, both slider elements are configured to be slid outwardly toward the distal edges of the stool platform to unlock the child-proof locking mechanism. In one embodiment, the child-proof locking mechanism further comprises a latch, a spring, and a locking bolt for each slider element. In another embodiment, the latch is attached to the underside of a slider element and the locking bolt is configured to fit within a slot; and wherein the spring is configured to bias the locking bolt within the slot such that the child-proof locking mechanism is biased in the locked position. In yet another embodiment, the slider element is configured to slide away from the slot such that the latch frees the locking bolt from the hole.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a foldable locking step stool.

For the purpose of this disclosure, the word "a" is defined to mean "at least one." The term "about" or "approximately" refers to a range of values within plus or minus 10% of the specified number or limitation. The term "substantially" means that the actual value is within about 10% of the actual desired value, particularly within about 5% of the actual desired value and especially within about 1% of the actual desired value of any variable, element or limit set forth herein. Unless otherwise defined, all technical terms used herein have the same meaning as commonly understood by one of ordinary skill in the art to which this disclosure belongs.

Figure 1:
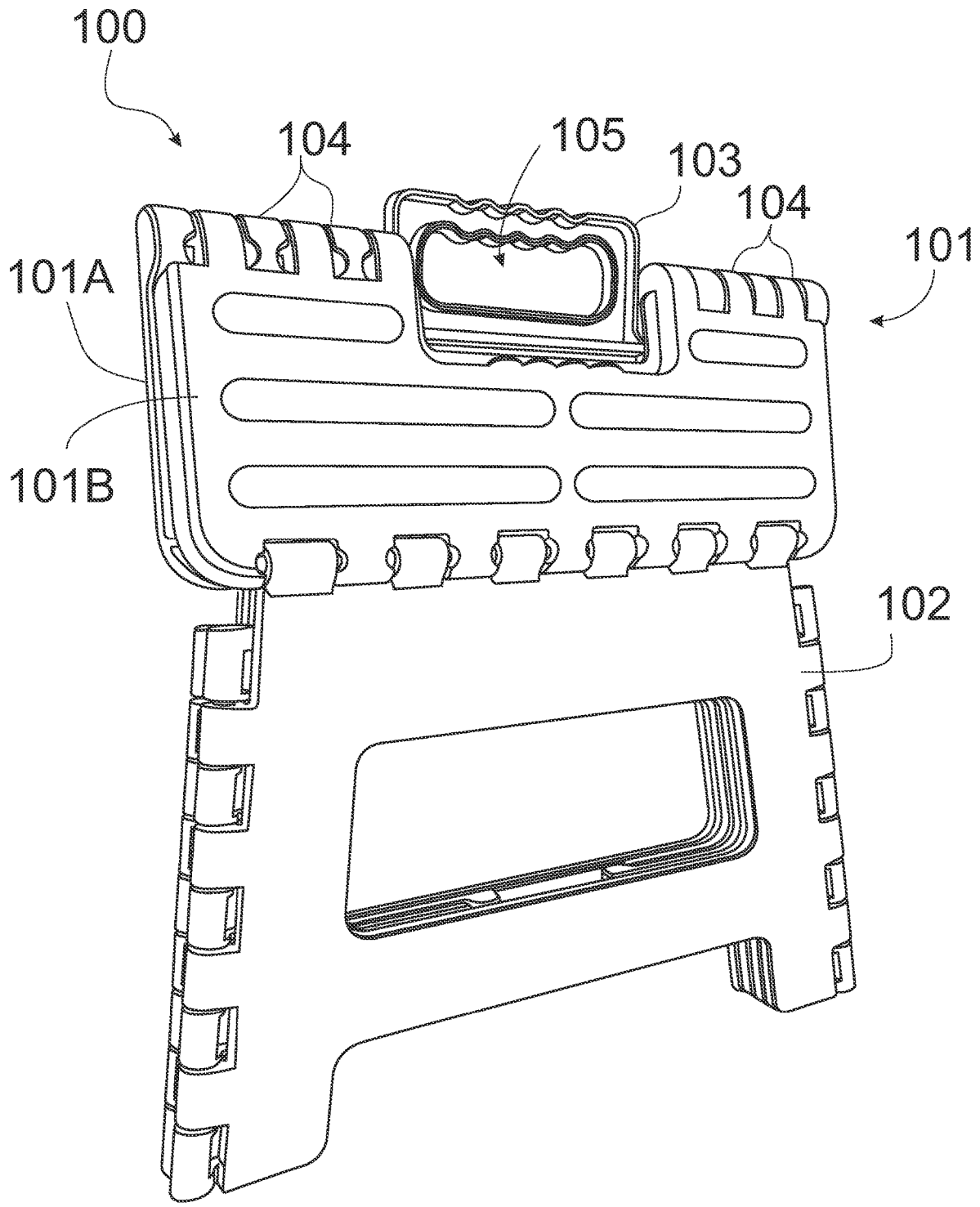
FIG. 1 is a perspective view of a foldable locking step stool shown in a closed position according to an embodiment of the present invention.

FIG. 1 is a perspective view of a foldable locking step stool shown in a closed position according to an embodiment of the present invention. Referring now to FIG. 1, the foldable locking step stool 100 is illustrated. In this view, the stool is folded into a closed position. This position is appropriate for storage and when the stool is not in use as well known in the art. In one embodiment, the foldable locking step stool 100 comprises a stool platform 101, legs 102, and a handle 103. In one embodiment, the stool platform 101 is configured to fold in half via hinge members 104 positioned centrally lengthwise along the length of the stool platform except for at a cutout 105 for the handle 103. The foldable stool platform defining a first stool platform member 101A and a second stool platform member 101B. In one embodiment, the hinge members 104 include a plurality of protrusions on the first stool platform member 101A and the second stool platform member 101B, wherein the plurality of protrusions are interconnected. In some embodiments, the interconnected protrusions are hingedly attached to each other. In other embodiments, a hinge element, such a shaft or pin is used to facilitate the rotation. It should be understood, that other means of rotation between the first stool platform member 101A and the second stool platform member 101B may be used.

Figure 2:
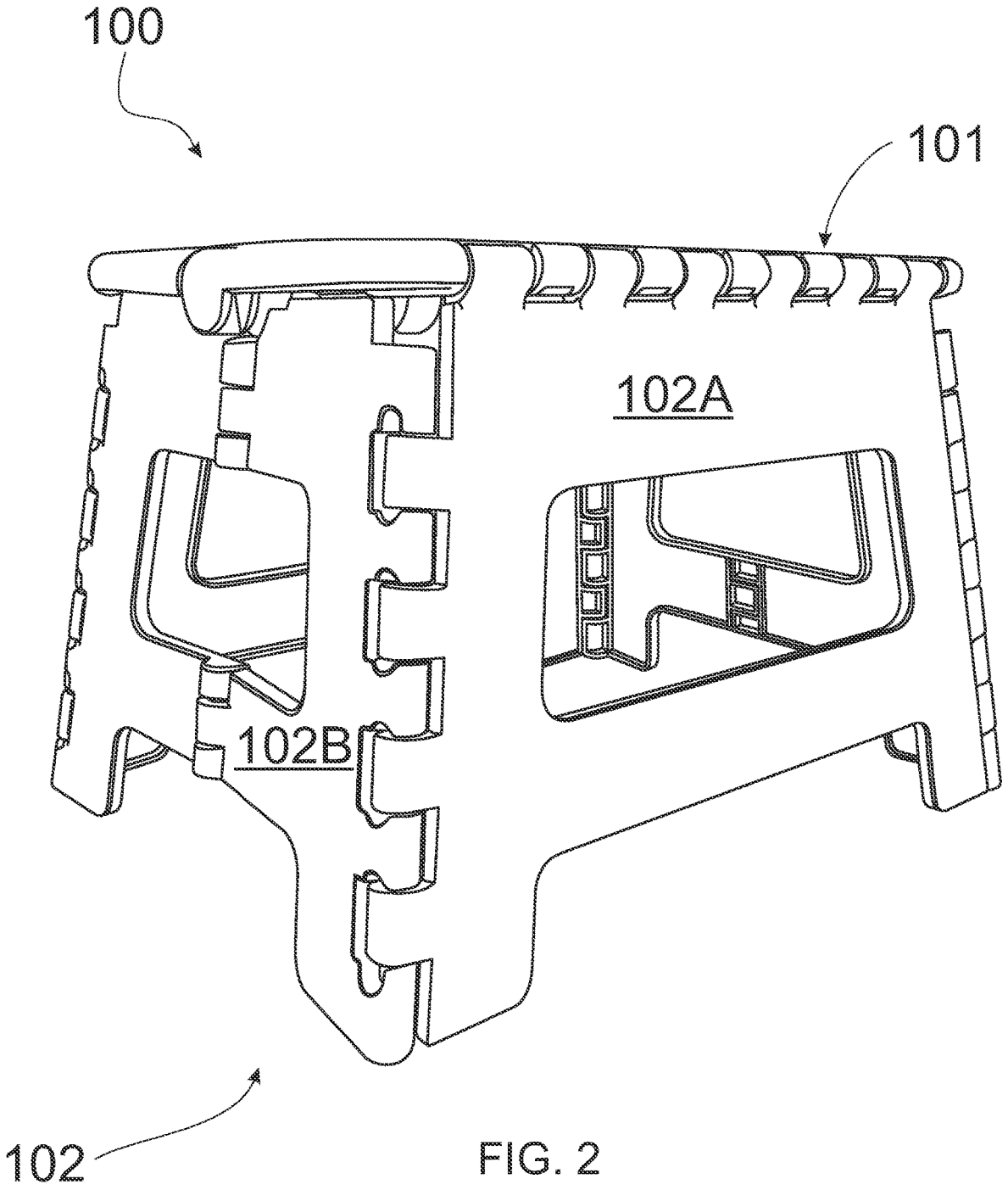
FIG. 2 is a perspective view of a foldable locking step stool shown in an opened position according to an embodiment of the present invention.

FIG. 2 is a perspective view of the foldable locking step stool shown in an open position according to an embodiment of the present invention. Referring now to FIG. 2, the step stool 100 is in the open position and is ready to use. In the open position, the legs 102 are expanded to support the stool platform 101 for use. In one embodiment, the legs 102 have a first pair of leg members 102A which are configured to hinge and rotate relative to the stool platform 101 and a second pair of leg members 102B hinged to the ends of the first pair of leg members and configured to fold inward when the stool 100 is in the closed state. It should be understood, that other leg types may be provided, and the illustrated legs are just an exemplary instance.

When the foldable locking step stool 100 transforms from a closed or stowed position (FIG. 1) to the open or ready for use position (FIG. 2) the stool platform 101 automatically locks in the open position via a locking mechanism. Advantageously, the locking mechanism must be activated to transform the foldable locking step stool 100 back to the closed position from the open position. The details of the locking mechanism will be further discussed below.

Figure 3:
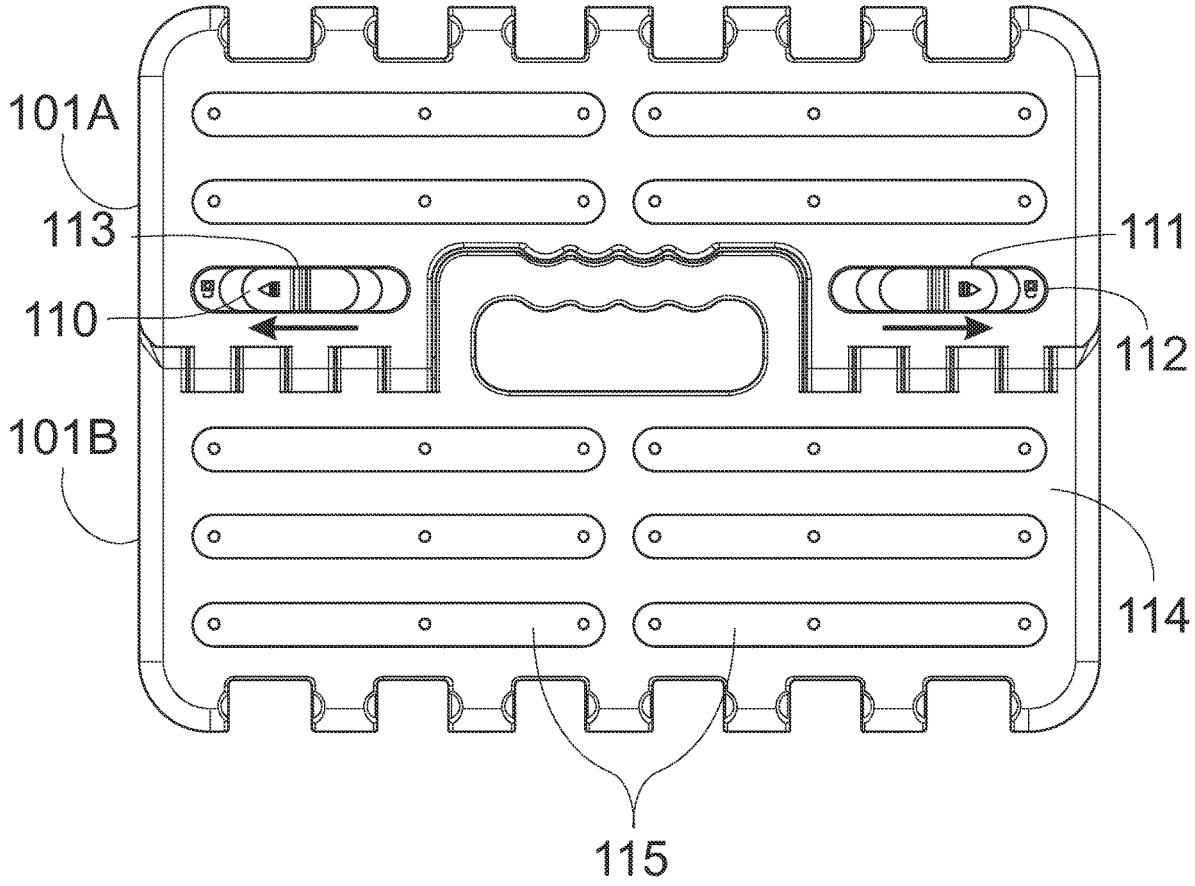
FIG. 3 is a top view the stool platform according to an embodiment of the present invention; and, FIG. 4 is a bottom view of the stool platform according to an embodiment of the present invention.

FIG. 3 is a top view of the stool platform 101 according to an embodiment of the present invention. Referring now to FIG. 3, the some components of the locking mechanism are illustrated. In one embodiment, the locking mechanism comprises a pair of slider elements 110 and 111 enabling a user to unlock the locking mechanism to allow the stool platform to fold into the first stool platform 101A and the second stool platform 101B along the hinge members such that the foldable locking step stool 100 can transform from the open position (FIG. 2) to the closed position (FIG. 1). In order for locking mechanism to release, both sliders elements 110 and 111 must be slid simultaneously outwardly toward the distal edges of the stool platform 101 (indicated by arrows illustrated in FIG. 3). Advantageously, the difficulty and simultaneous nature of the pair of slider elements provides a child proof locking mechanism which ensures a child does not fold the stool (accidently or intentionally). This prevents possible injuries, such as the child's fingers being pinched as the stool folds. Also, the structure and components of the locking mechanism ensures a child would likely not be able to have the strength and dexterity to release the locking mechanism even if they knew how to operate the lock. This will be discussed in further details below.

In some embodiments, text, systems, or insignia 112 may be provided to indicate how to operate the locking mechanism. In some embodiments, the pair of slider elements 110/111 comprises texture or raised elements 113 to assist a user and provide traction to operate and slide the pair of slider elements. In one embodiment, top surface 114 of the stool 100 includes a plurality of traction grips 115 preventing the child or user's feet from slipping off the stool during use. In one embodiment, the plurality of traction grips 115 are constructed from a TPE (thermoplastic elastomer) overmold, creating a rigid bond between the TPE and the rigid material of the top portion of the step stool platform 101. In one embodiment, the rigid material of the step stool platform may be a hard plastic or other rigid material capable over being overmolded such a metal.

Figure 4:
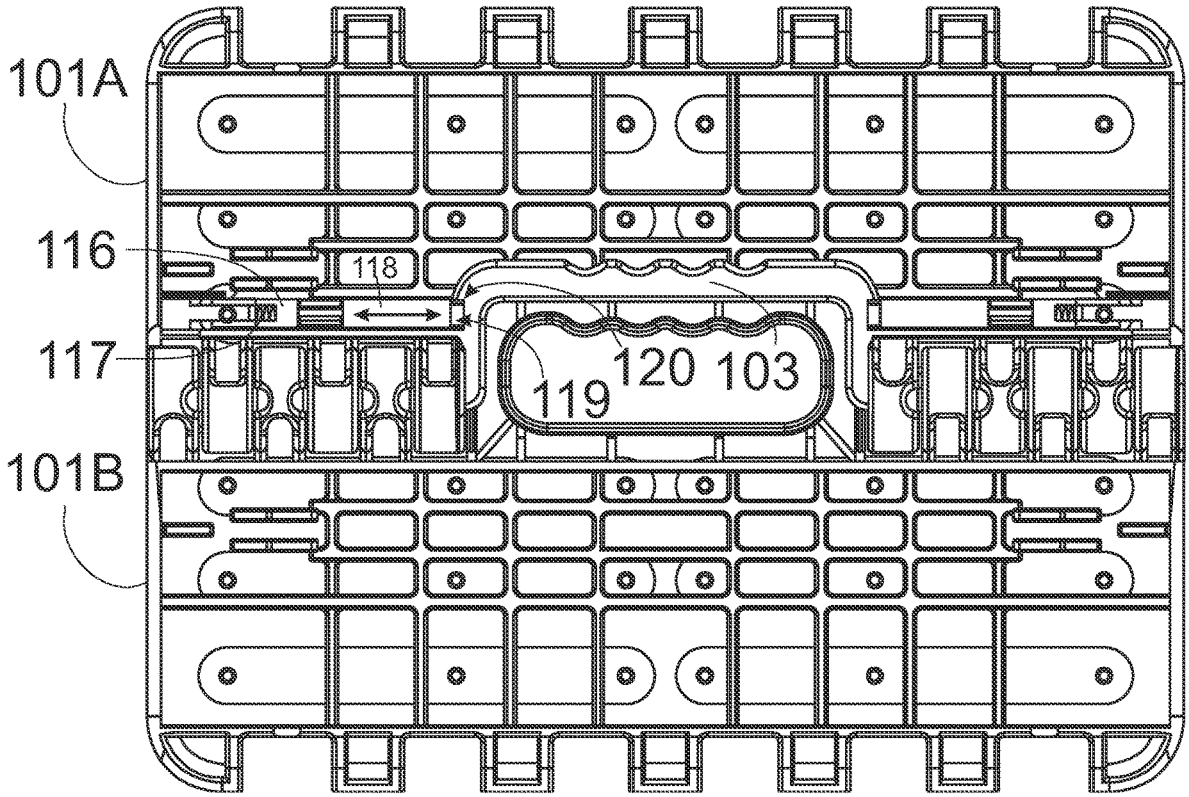

FIG. 4 is a bottom view of the stool platform according to an embodiment of the present invention. Referring now to FIG. 4, the operation and components of the locking mechanism are visible. In one embodiment, the locking mechanism comprises latch 116, spring 117, engagement member 118, and locking bolt member 119. It should be understood that these same elements are located on both sides of the stool platform on the underside of each slider element 110/111. The latch 116 is attached to the underside of a slider element, e.g. 111. In some embodiments, the latch 116 is configured to engage the engagement member 118, wherein the engagement member 118 includes the locking bolt member 119 at a distal portion of the engagement member 118. In other embodiments, the latch 116 is coupled or attached to the engagement member 118. In one embodiment, the locking bolt member 119 is a portion of the engagement member 118. In another embodiment, the locking member 119 is a continuous portion of the engagement member 118. In one embodiment, the locking bolt member 119 is configured to slide within a slot 120, wherein the slot 120 is built-in into a portion of stool platform. In other embodiments, the slot may be located within the handle 103. Advantageously, the spring 117 is configured to bias the engagement member 118 distally and the attached locking bolt member within the slot, such that the stool is defaulted into a locked state when the stool is in the open position.

During operation to release the locking mechanism, the slider element is pushed and slid outwardly, which also moves the latch 116 outwardly, bringing and moving the engagement member 118 and the locking member 119 distally such that the locking member 119 is free from the slot 120. As previously mentioned, both slider elements 110/111 (FIG. 3) must be engaged simultaneously to release both locking members from their respective holes which enables the stool platform 101 to be folded into two portions defining the first stool platform member 101A and the second stool platform member 101B.

It should be understood, that the following locking mechanism provides one exemplary instance of a child proof locking mechanism for a foldable step stool. Other locking techniques may be provided such as cam style rotational locks, wherein a locking member engages a similar slot or hole with rotational motion instead of the lateral motion described herein. Similarly, the locking mechanism may include additional layers to operation, such as push, and then slide functionality, wherein each slider elements must be pushed downwardly prior to sliding outwardly for the locking bolt member to release from the hole or slot. However, the best mode embodiment described herein provides a child proof locking mechanism that is simple, easy, and efficient to operate for an adult yet designed to keep children from being able to disengage the lock.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

Referring now to any of the accompanying FIGS. 1-4, the handle's position within the stool provides an advantage as it is not exposed or accessible when the stool is in the open position. In one embodiment, the handle is an extension of a portion of the stool platform, for instance It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A foldable locking step stool comprising:

a stool platform configured to hingedly fold into a first stool platform member and a second stool platform member;

leg members hingedly coupled to the stool platform;

a child-proof locking mechanism; an open position defining when the first stool platform member and the second stool platform are locked via the child-proof locking mechanism in a single plane wherein the foldable locking step stool is ready for use; and, a closed position defining when the first stool platform member and the second stool platform are unlocked via the locking mechanism child-proof and folded wherein the foldable locking step stool is configured to be moved or stowed, wherein the locking mechanism comprises first and second slider elements positioned on opposite lateral edges of the stool platform, each slider element being manually actuatable only in an outward direction each slider element being operatively connected to a spring-biased locking bolt configured to engage a corresponding recess in the first and second stool platform members, the bolts being interlocked through a linkage that requires concurrent displacement of both slider elements to disengage both spring-biased locking bolts.

2. The foldable locking step stool of claim 1, wherein the first stool platform member and the second stool platform member are configured to fold such that the bottom surfaces of each stool platform member face each other.

3. The foldable locking step stool of claim 1, wherein each stool platform member comprises a plurality of protrusions configured to interconnect with each other.

4. The foldable locking step stool of claim 3, wherein the interconnected protrusions are hingedly attached to each other forming a hinge member enabling the folding of the first stool platform member and the second stool platform member.

5. The foldable locking step stool of claim 3, wherein the interconnected protrusions surround a hinge pin.

6. The foldable locking step stool of claim 1, further comprising a handle.

7. The foldable locking step stool of claim 6, wherein the handle is an extension of the second stool platform member.

8. The foldable locking step stool of claim 7, wherein the first stool platform member comprises a cutout sized and shaped to receive the handle when the stool platform is in the open position.

9. The foldable locking step stool of claim 1, wherein the stool platform includes a plurality of traction grips preventing the child from slipping off the step stool during use.

10. The foldable locking step stool of claim 2, wherein the plurality of traction grips are constructed from a thermoplastic elastomer overmold creating a rigid bond between the plurality of traction grips and a top portion of the stool platform, wherein the stool platform is constructed from a rigid material.

11. The foldable locking step stool of claim 1, wherein the child-proof locking mechanism further comprises a latch, a spring, and a locking bolt for each slider element.

12. The foldable locking step stool of claim 11, wherein the latch is attached to the underside of a slider element and the locking bolt is configured to fit within a slot; and wherein the spring is configured to bias the locking bolt within the slot such that the child-proof locking mechanism is biased in the locked position.

13. The foldable locking step stool of claim 12, wherein the slider element is configured to slide away from the slot such that the latch frees the locking bolt from the hole.

* * * * *